United States Patent [19]

Lai

[11] Patent Number: 4,811,885

[45] Date of Patent: Mar. 14, 1989

[54] POWER TRANSMISSION MECHANISM OF AN ELECTRIC STAPLER

[76] Inventor: Wen-Tan Lai, No. 11, Ya Hsiu Road, Taya Hsiang, Taichung Hsien, Taiwan

[21] Appl. No.: 174,457

[22] Filed: Mar. 23, 1988

[51] Int. Cl.[4] ..... B25C 5/15

[52] U.S. Cl. ..... 227/131

[58] Field of Search ..... 227/120, 131, 156, 147

[56] References Cited

U.S. PATENT DOCUMENTS 4,640,452 2/1987 Matt et al. ..... 227/147

*Primary Examiner*—Paul A. Bell

[57] ABSTRACT

The present disclosure is related to a power transmission mechanism for use in an electrically operated stapler, which includes a high speed motor driving a flywheel through a pair of speed reducing gears; on the flywheel is disposed a vertical pin which is moved in synchronism with the wheel in each cycle to hit a ram member having a spring located therebehind which can be compressed then extended to force the ram to strike a staple in a power stroke. Thus the present electric stapler is free of use of a conventional electromagnetic coil; besides, the striking force of the ram can be more stable, not influenced by the inefficiency of local power supply, because of the adoption of a rechargeable battery disposed within the casing of the present stapler.

4 Claims, 2 Drawing Sheets

FIG. 2
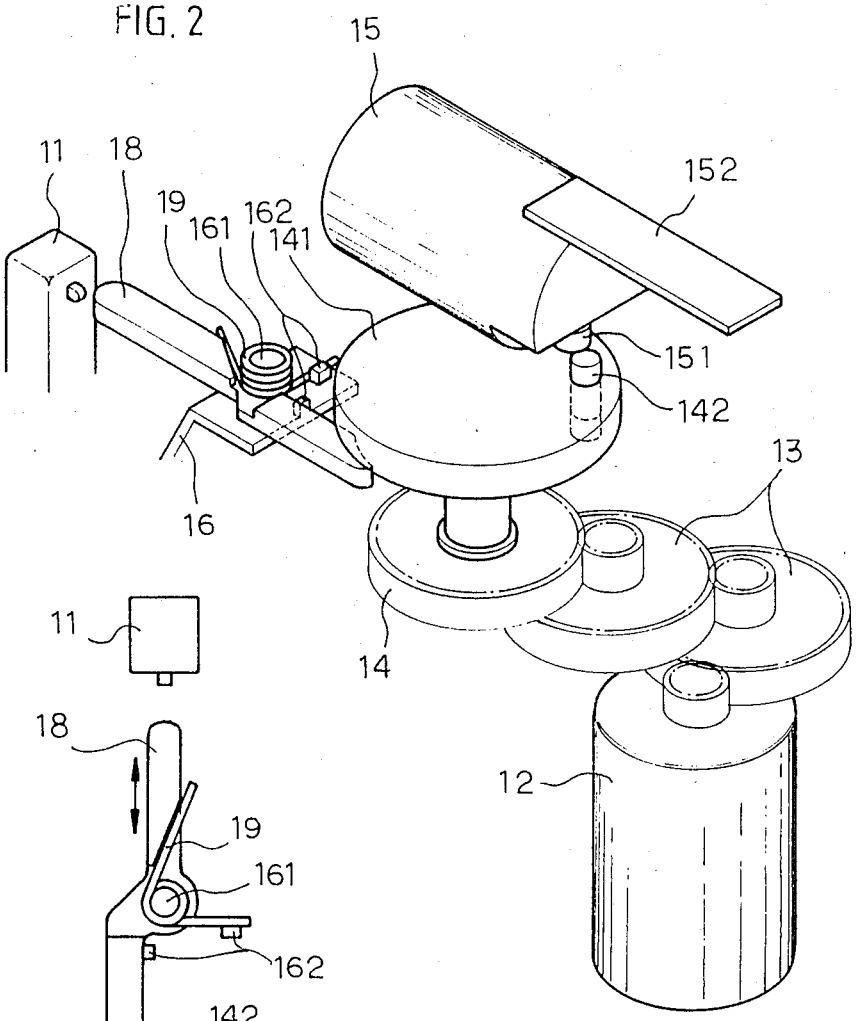
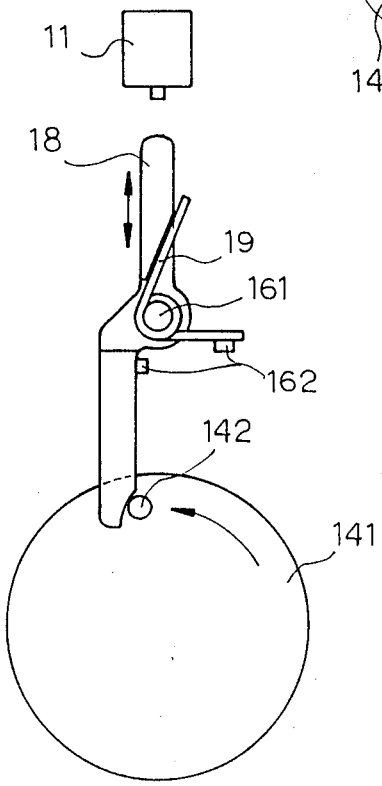
FIG. 3

POWER TRANSMISSION MECHANISM OF AN ELECTRIC STAPLER

SUMMARY OF THE INVENTION

The present invention relates to a power transmission mechanism for use in an electrically operated stapler, a high speed motor is used to drive a flywheel via a pair of speed reducing gears; on the flywheel, near the peripheral edge thereof, is disposed a vertical pin which is moved at high speed along with the spinning flywheel to strike a ram in a power stroke, and the struck ram is moved against a spring disposed tberebehind, making the same compressed, and the re-extending spring force the ram to stike a target at a high speed in operation. The present electrical stapler depends on a rechargeable battery in power supply, thus is free of any restraint in regional electrical source, and is operated in a more stable manner. The present stapler is further characterized by its adoption of a selector switch which is able to shift to another position at the end of a power stroke when the power switch is released to produce a short circuit, thus a "reverse electromotive force" is produced in the electric circuit to brake the motor immediately so that the pin 142 can obtain a maximum travelling distance for acceleration in the next power stroke. In such a manner, electrical power can be consumed in a more economic wy and the electric motor can have longer operation life accordingly.

In a common electric stapler of the prior art, it is indispensable to adopt at least an electromagnetic coil surrounding externally a ram means to establish a magnetic field for accelerating the same; or compressed air is used to serve as a source of power to actuate a ram means to strike a staple. A German patent, Ser. No. 2330958, is a typical electrical stapler of the prior art, having the disadvantage in operation, i.e. the striking force exerted on a staple is unstable, subjected to the condition of a local power supply, and also to the number of windings of the electromagnetic coils used in the stapler.

Therefore, the primary object of the present invention is to provide a power transmission mechanism for use in an electrically operated stapler, which mainly includes a high speed motor diriving a flywheel on which a vertical pin is planted; and the vertical pin is moved in synchronism with said flywheel to strike a ram means in each power stroke; and a rechargeable battery is provided in the present stapler so that the same can be operated in a more stable and convenient manner.

One further object of the present invention is to provide a power transmission mechanism for use in an electric stapler which is equipped with a trigger means coupled to a control switch with a selector switch disposed therein, which is able to switch to another status as long as the control switch is released, so that the high speed motor can be stopped immediately as a result of an instant reverse electro magnetic force being produced thereby; thus the vertical pin on the flywheel, used to hit a ram means, can obtain a maximum travelling distance for acceleration in a subsequent power stroke.

One still further object of the present invention is to provide a power transmission mechanism for use in an electric stapler which is provided with an adjusting screw means on the casing thereof, which is in abutment with the bias spring disposed behind the ram means so that by adjusting the screw means the exertion force of the bias spring on the ram means can be accordingly adjusted.

One still further object of the present invention is to provide a power transmission mechanism for use in an electric stapler which is provided with a flywheel with a vertical pin planted thereon to hit a ram means in each power stroke, and a removable pin element or a bolt is placed on the ram means at the place in the route of the vertical pin, thus the ram means will not be worn out by constant impact, and the worn-out pin element can be readily replaced instead of the expensive ram means.

To better illustrate the structure, operation modes and features of the present invention, a number of drawings are provided along with a detailed description of the present invention, in which:

BRIEF DESCRIPTION OF THE DRAWINGS

FIG. 2 is a diagram selectively showing the primary structure of the present invention;

FIG. 3 is a diagram showing the flywheel moving against the link to control the switch;

DETAILED DESCRIPTION OF THE PREFERRED EMBODIMENT

Figure 1:
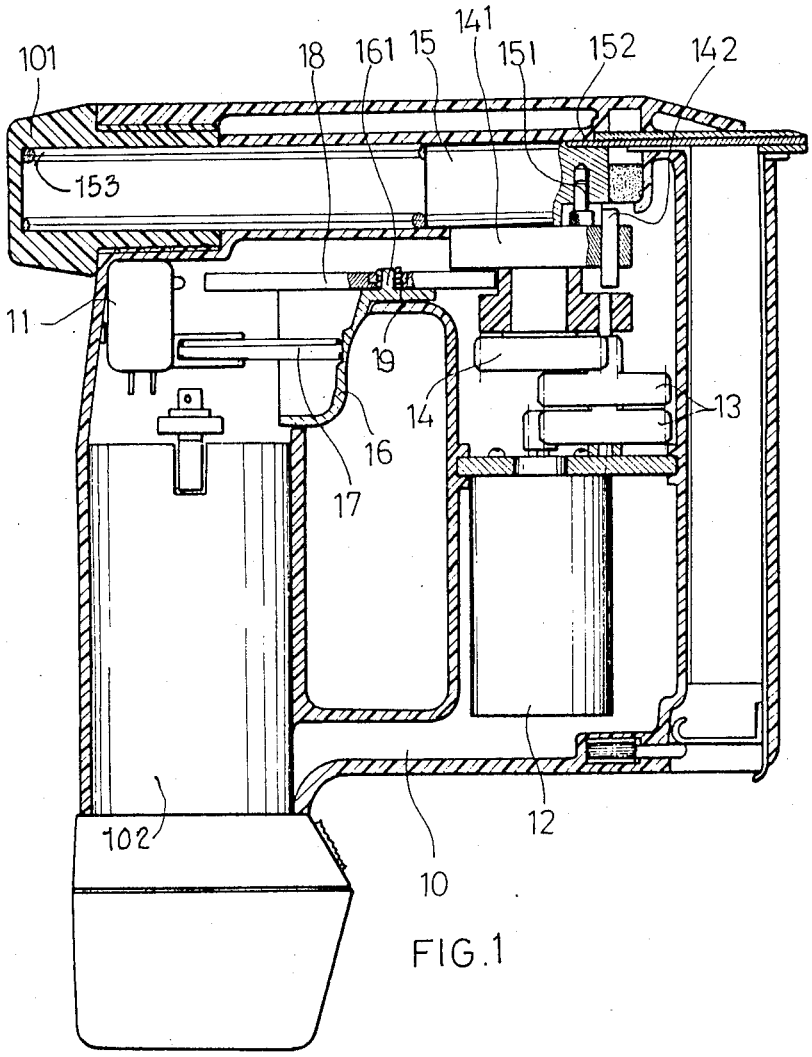
FIG. 1 is a sectional view of the present invention.

As shown in FIGS. 1, 2, the present stapler has a casing 10 with a magazine disposed on the handle thereof for receiving a rechargeable battery 102, and a control switch 11 is located above the battery 102, and a high speed motor 12 is disposed in front of the battery 102 with a rectangular opening defined therebetween in which a trigger means 16 is located., a bias spring 17 is disposed behind the trigger means and in abutment with the same.

A cylindrical projection 161 is defined on the upper portion of said trigger means as shown in FIG. 2 for effecting the connection of a link 18 thereto, with a coil spring 19 mounted thereon. In the vicinity of the cylindrical projection 161 are disposed a pair of protruded blocks 162. One of the blocks 162 is used to restrain one of the extended legs of said coil spring in place, and the other leg thereof is in abutment with the inclined side of the link 18, thus the pivotal movement of said link 18 can be retractably limited within a proper range.

Said high speed motor 12 and control switch 11 are electrically connected to each other by wires. The gear attached to the top end of the shaft of the motor 12 is engaged with a pair of speed reduction gears 13, one of which is further engaged with a dirven gear 14 provided with a flywheel 141 so that the flywheel is able to be driven to spin.

A vertically planted pin 142 is disposed near the periphery of the flywheel 141 and can periodically engage with a ram 15 and the link 18 so to make the former move in the longitudinal direction thereof, and the latter can swing clockwisely when the flywheel 141 is rotated in counterclockwise direction and comes into contact with the front end of the link 18 as shown in FIG. 3.

Right behind said ram 15, a bias spring 153 is disposed, and the longitudinal rear movement of the ram 15 will make the spring 153 compressed, and on the pin 142 being disengaged with the ram 15, the compressed spring 153 will force the ram 15 to extend outward at a fast speed, and an extended oblong piece 152 fixed at the front end of said ram is moved along therewith for effecting the strike of a staple.

Subsequently, the rotating flywheel 141 will bring the pin 142 come into contact with the front end of said link 18 so to make the same pivot with respect to the cylindrical projection 161 within a proper range. The pivotal movement of the link 18 will make the rear end thereof disengage with the control switch 11. The pin 142 continues to move and releases the pivoted link 18 consequently. The released link 18 will resume its original position by means of the coil spring and is stopped by the protruded blocks 162, ready for the next cycle of operation. The trigger means 16, in synchronism with the pivotal movement of the link 18 by the pin 142, will be forced back to its non-operative position by spring 17.

Figure 4:
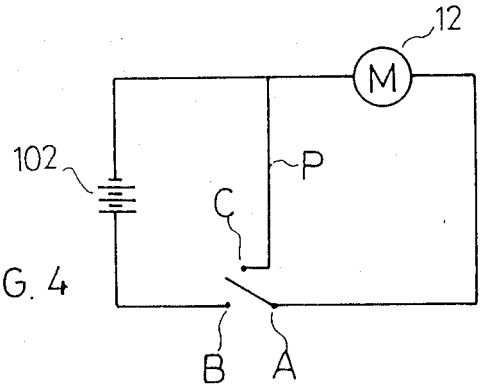
FIG. 4 is a diagram showing the electric circuit of the present invention.

Right on said control switch 11 being released, the selector switch within the switch 11 will jump from point "B" to point "C", thus instantly making the points "C" and "A" have an identical polarity, and an instantaneous reverse current is accordingly produced along the path indicated by "P", induced by the instantly established "reverse electromotive force", and a sudden brake effect is produced on the motor, the electric circuit is as shown in FIG. 4, so that the flywheel 141 as well as the pin 142 can be stopped right away. Thus the pin 142 can have a maximum travelling distance for acceleration for next power stroke. In such a manner, the motor is not required to provide excessive power as, usual, for making the pin 142 to reach equal speed in a shorter range to effect a powerful strike on said ram 15, therefore the battery and the motor of the present invention can enjoy a longer operation life thereby.

To prevent the ram 15 from being damaged or worn out by constant impacts by the pin 142, a replaceable pin element 151 is disposed in front of the striking point on the ram 152 so that either the pin element 151 or pin 142 can be readily replaced after being worn out with only a small amount of expenditure.

To cope with various working conditions in which staples must be hit into walls of different thickness, an adjusting screw 101, in abutment association with the rear end of said spring 153, is provided; and the screw 101 is threadly fastended to the casing 10 so that by turning the screw 101, the length of said spring 153 can be properly changed, so the force exerting on said ram 15 is accordingly altered.

The advantageous features of the present invention lie in that:

1. the striking force of the ram of the present invention in a power stroke can be flexibly adjusted by way of a screw means to meet different practical requirements in hitting staples to walls of various thickness or into work objects of different materials;

2. the use of a rechargeable battery permits the present stapler being carried along and used in any normal working condition and free of the disadvantageous influence of local power supply.

What is claimed:

1. A power transmission mechanism for use in an electrically operated stapler, comprising:

a casing;

an electrical power means coupled to a control switch disposed within the casing;

a pair of speed reducing gears in engagement with each other;

a driven gear in engagement with one of said speed reducing gear;

a flywheel horizontally disposed and mounted on the top end of the axle of said driven gear, with a vertical pin projected from the top surface thereof and located near the peripheral edge thereof;

a ram means having an oblong piece extending from the front end thereof serving as a hitting means, and the underside of said ram means being provided with a vertical wall;

a trigger means in association with a bias spring for permitting the same to be retractably operated;

a link in operative association with said trigger means by pivotably fixing the link to a cylindrical projection on the trigger means, and a coil spring being engaged with both said link and said trigger means so that the link can be resiliently operated in response to the actuation of said trigger means.

2. A power transmission mechanism as claimed in claim, wherein a pin element is removable fixed on the ram means at the place in the route of the moving vertical pin of the flywheel so that the ram means is hit by the vertical pin indirectly via said pin element which is ready to be replaced after being worn out.

3. A power transmission mechanism as claimed in claim 1, wherein an adjusting screw is mounted on said casing of the stapler and in abutment with the bias spring which is disposed behind the ram means so that the exertion force of said spring on said ram means can be adjusted by way of rotating said adjusting screw in either direction.

4. A power transmission mechanism as claimed in claim 1, wherein a selector switch is disposed within the control switch so that the selector switch can be instantly shifted to the other position when the control switch is off so to make the high speed motor to have indentical poles at an instant moment to effect a reverse electromagnetic force for braking the motor immediately.

* * * * *